US008155572B2

(12) United States Patent
Richards et al.

(10) Patent No.: US 8,155,572 B2
(45) Date of Patent: Apr. 10, 2012

(54) DUAL POSITION PRE-TRANSFER ASSEMBLY

(75) Inventors: Paul N Richards, Fairport, NY (US); Donald C Koch, Webster, NY (US); Paul F Sawicki, Rochester, NY (US); Richard A Vandongen, Newark, NY (US)

(73) Assignee: Xerox Corporation, Norwalk, CT (US)

( * ) Notice: Subject to any disclaimer, the term of this patent is extended or adjusted under 35 U.S.C. 154(b) by 95 days.

(21) Appl. No.: 12/814,653

(22) Filed: Jun. 14, 2010

(65) Prior Publication Data

US 2011/0305490 A1 Dec. 15, 2011

(51) Int. Cl.
*G03G 15/00* (2006.01)
*G03G 15/16* (2006.01)

(52) U.S. Cl. ..... 399/316; 399/45; 399/388

(58) Field of Classification Search ..... 399/316, 399/317, 45, 390, 388
See application file for complete search history.

(56) References Cited

U.S. PATENT DOCUMENTS

| | | | | |
|---|---|---|---|---|
| 5,761,596 | A | 6/1998 | Osbourne et al. | |
| 5,920,746 | A * | 7/1999 | Thomas et al. | 399/45 |
| 6,055,409 | A * | 4/2000 | Richards et al. | 399/388 |
| 6,097,925 | A * | 8/2000 | Nagaoka et al. | 399/316 |
| 2006/0045580 | A1 * | 3/2006 | Matsuura | 399/316 |

* cited by examiner

*Primary Examiner* — Sophia S Chen

(57) ABSTRACT

A dual mode media registration transport and media pre-transfer baffle arrangement within a printer enables printing onto normal and heavy weight media materials. In a first mode, the arrangement allows normal media to enter pre-transfer baffles with the normal "S" shape, which allows all performance specifications to be maintained. To accommodate heavy weight media, the registration transport and pre-transfer baffles are moved into a second mode position which straightens the media path and enables heavy weight media to enter the pre-transfer area. Thus, enabling the printing of these materials which could not be processed through the "S" shape baffle arrangement.

18 Claims, 3 Drawing Sheets

DUAL POSITION PRE-TRANSFER ASSEMBLY

BACKGROUND

1. Field of the Disclosure

This invention relates generally to dual position media registration and media pre-transfer baffle geometry, and more particularly, to a two-position pre-transfer apparatus that enables printing onto heavy weight media.

2. Description of Related Art

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. An electrostatic latent image is thus recorded onto the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules to the latent image forming a toner powder image on the photoconductive member. The toner powder image is then transferred from the photoconductive member to a copy sheet, for example, as shown in U.S. Pat. No. 5,761,596 to William G. Osbourne et al. The toner particles are heated to permanently affix the powder image to the copy sheet.

However, existing media pre-transfer geometry limits the pre-processing of heavy media weights based on its inherent "S" baffle pre-transfer geometry as shown in prior art FIG. 1. The packaging industry, in most cases, requires greater than 350 gsm media to be images. This media weight requirement creates a limitation with the pre-transfer and registration hardware of current machines such as shown in FIG. 1.

For example, in Prior Art FIG. 1, the pre-transfer baffle gap between baffles 16 and 17 allow for an "S" shaped buckle to form in the media 18 with an angle of engagement of media 18 with photoreceptor 10 of about 28°. This allows for some mismatch in velocities of a registration nip formed between idler roll 14 and drive roll 15 and the photoreceptor 10 which is entrained around drive roll 11 and idler roll 12. An idler roll 13 is used to maintain frictional contact between sheet 18 and photoreceptor 10. A larger transfer baffle gap allows for the formation of buckles and can lead to lead edge stubbing with curled sheets. Both characteristics degrade registration and transfer performance on heavy weight media.

Hence, wider media weight latitude, allowing printers to migrate into the packaging and other industries is required.

SUMMARY

Accordingly, a dual position media registration transport and media pre-transfer baffle device is disclosed that enables printing onto heavy weight media materials. In a first or standard mode position, the device allows the normal media to enter the pre-transfer baffles with the normal "S" shape, which allows all performance specifications to be maintained. To accommodate heavy weight media, the device is moved into a second mode position which straightens the media path and enables heavy weight media to enter the pre-transfer area. Thus enabling the printing of these materials which could not be processed through the "S" shape baffle arrangement.

The disclosed reprographic system that incorporates the disclosed improved device that improves media registration at transfer may be operated by and controlled by appropriate operation of conventional control systems. It is well-known and preferable to program and execute imaging, printing, paper handling, and other control functions and logic with software instructions for conventional or general purpose microprocessors, as taught by numerous prior patents and commercial products. Such programming or software may, of course, vary depending on the particular functions, software type, and microprocessor or other computer system utilized, but will be available to, or readily programmable without undue experimentation from, functional descriptions, such as, those provided herein, and/or prior knowledge of functions which are conventional, together with general knowledge in the software of computer arts. Alternatively, any disclosed control system or method may be implemented partially or fully in hardware, using standard logic circuits or single chip VLSI designs.

As to specific components of the subject apparatus or methods, or alternatives therefore, it will be appreciated that, as normally the case, some such components are known per se' in other apparatus or applications, which may be additionally or alternatively used herein, including those from art cited herein. For example, it will be appreciated by respective engineers and others that many of the particular components mountings, component actuations, or component drive systems illustrated herein are merely exemplary, and that the same novel motions and functions can be provided by many other known or readily available alternatives. All cited references, and their references, are incorporated by reference herein where appropriate for teachings of additional or alternative details, features, and/or technical background. What is well known to those skilled in the art need not be described herein.

The term 'normal media' herein refers to any flimsy physical sheet or paper, plastic, or other useable physical substrate for printing images thereon, whether precut or initially web fed. The phrase "heavy weight media" refers to materials, such as, packaging, greeting cards, etc.

BRIEF DESCRIPTION OF THE DRAWINGS

Various of the above-mentioned and further features and advantages will be apparent to those skilled in the art from the specific apparatus and its operation or methods described in the example(s) below, and the claims. Thus, they will be better understood from this description of these specific embodiment(s), including the drawing figures (which are approximately to scale) wherein:

DETAILED DESCRIPTION OF THE PREFERRED EMBODIMENT

Figure 1:
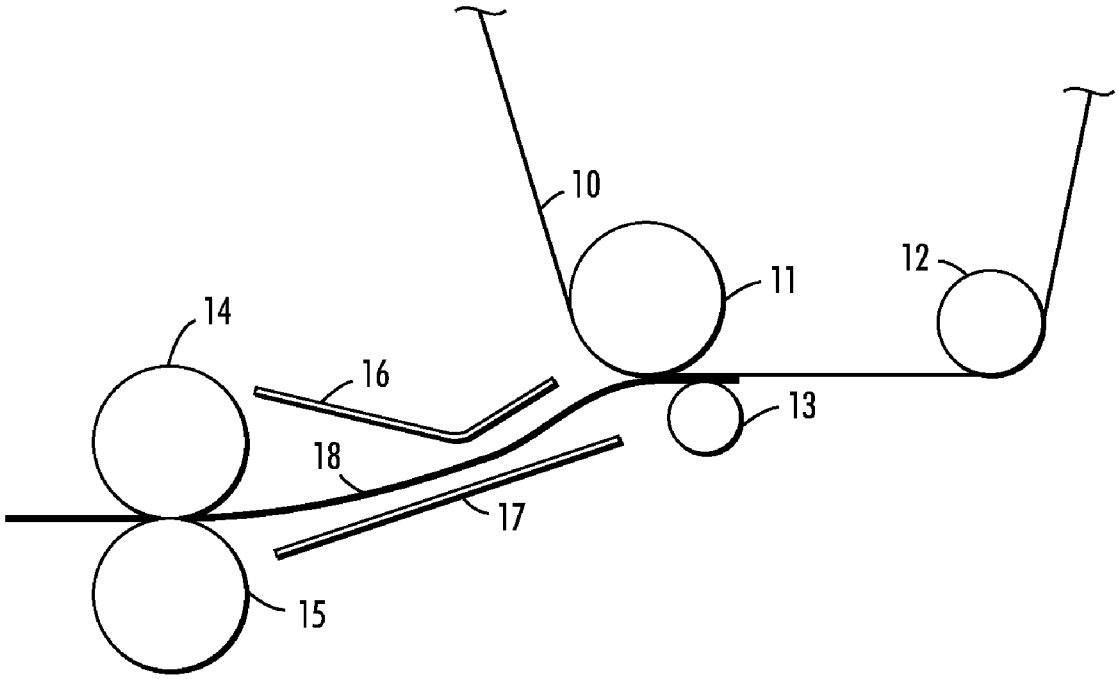
FIG. 1 PRIOR ART
FIG. 1 is an enlarged, partial frontal view of prior art registration and photoreceptor subsystems for registering sheets with a photoreceptor.

While the disclosure will be described hereinafter in connection with a preferred embodiment thereof, it will be understood that limiting the disclosure to that embodiment is not intended. On the contrary, it is intended to cover all alternatives, modifications and equivalents as may be included within the spirit and scope of the disclosure as defined by the appended claims.

The disclosure will now be described by reference to a preferred embodiment xerographic printing apparatus that includes a method and apparatus for enabling printing onto heavy weight materials.

For a general understanding of the features of the disclosure, reference is made to the drawings. In the drawings, like reference numerals have been used throughout to identify identical elements.

Figure 2:
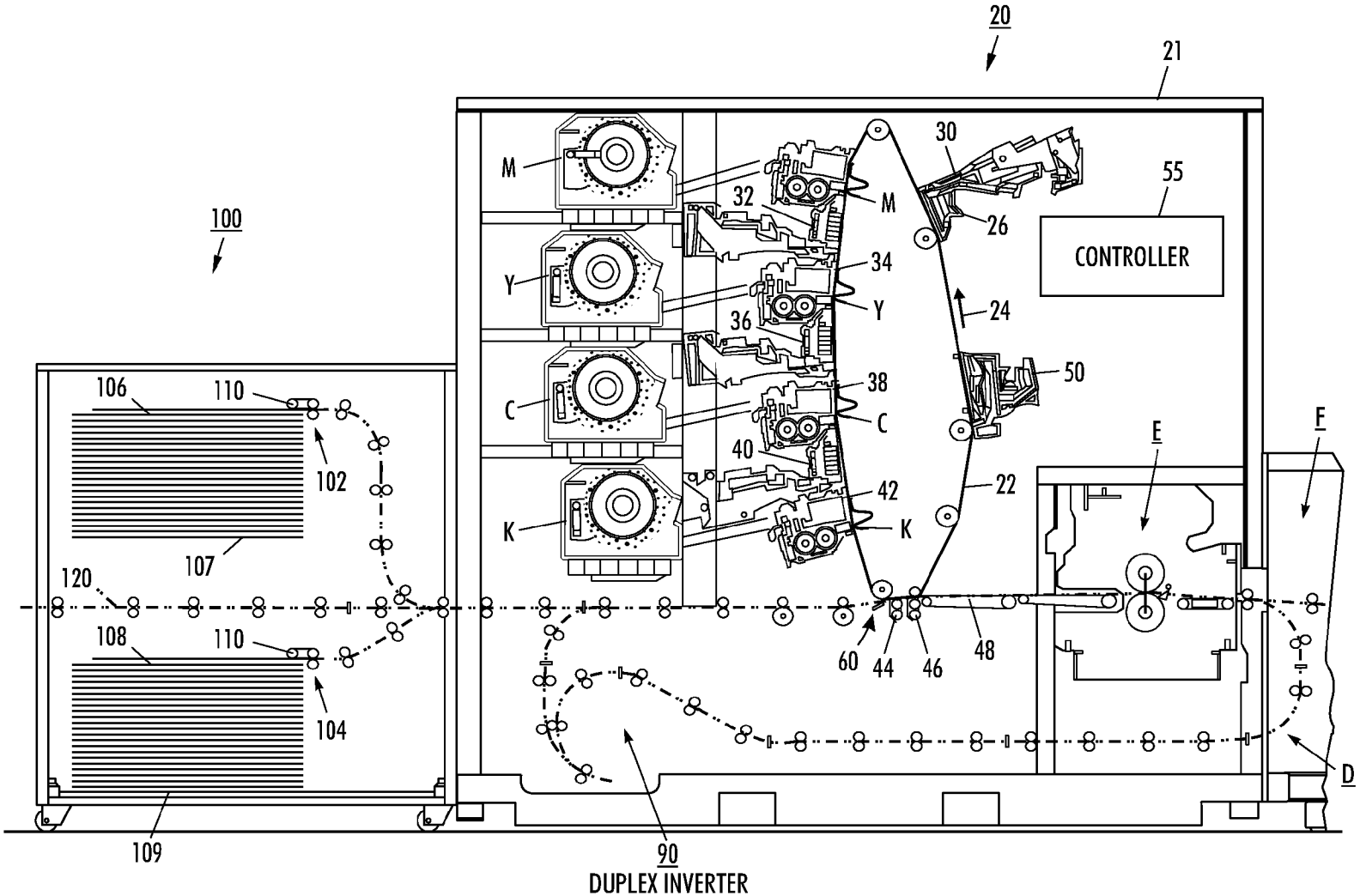
FIG. 2 is a partial, frontal view of an exemplary modular xerographic printer that includes a registration and pre-transfer subsystem in accordance with the present disclosure for improved registering of heavy weight sheets with a photoreceptor.

Referring now to printer 20 in FIG. 2, as in other xerographic machines, and as is well known, an electrographic printing system is shown including the dual position media registration transport and pre-transfer baffle subsystem of the present disclosure for improved media registration of heavy weight media at transfer. The term "printing system" as used here encompasses a printer apparatus, including any associated peripheral or modular devices, where the term "printer" as used herein encompasses any apparatus, such as a digital copier, bookmaking machine, facsimile machine, multifunction machine, et., which performs a print outputting function for any purpose. Marking module 21 includes a charge retentive substrate which could be a photoreceptor belt 22 that advances in the direction of arrow 24 through the various processing stations around the path of belt 22. Charger 26 charges an area of belt 22 to a relatively high, substantially uniform potential. Next, the charged area of belt 22 passes laser 30 to expose selected areas of belt 22 to a pattern of light, to discharge selected areas to produce an electrostatic latent image. Next, the illuminated area of the belt passes developer unit M, which deposits magenta toner on charged areas of the belt.

Subsequently, charger 32 charges the area of belt 22 to a relatively high, substantially uniform potential. Next, the charged area of belt 22 passes laser 34 to expose selected areas of belt 22 to a pattern of light, to discharge selected areas to produce an electrostatic latent image. Next, the illuminated area of the belt passes developer unit Y, which deposits yellow toner on charged areas of the belt.

Subsequently, charger 36 charges the area of belt 22 to a relatively high, substantially uniform potential. Next, the charged area of belt 22 passes laser 38 to expose selected areas of belt 22 to a pattern of light, to discharge selected areas to produce an electrostatic latent image. Next, the illuminated area of the belt passes developer unit C, which deposits cyan toner on charged areas of the belt.

Subsequently, charger 40 charges the area of belt 22 to a relatively high, substantially uniform potential. Next, the charged area of belt 22 passes laser 42 to expose selected areas of belt 22 to a pattern of light, to discharge selected areas to produce an electrostatic latent image. Next, the illuminated area of the belt passes developer unit K, which deposits black toner on charged areas of the belt.

As a result of the processing described above, a full color toner image is now moving on belt 22. In synchronism with the movement of the image on belt 22, a dual position pre-transfer baffle system 60 that is more particularly disclosed and described herein with reference to FIGS. 3 and 4, receives copy sheets from sheet feeder module 100 and brings the copy sheets into contact with the image on belt 22. Sheet feeder module 100 includes high capacity feeders 102 and 104 that employ retard sheet feeders 110 to feed sheets from sheet stacks 106 and 108 positioned on media supply trays 107 and 109 and directs them along sheet path 120 to imaging or marking module 21. Additional high capacity media trays or sheet inserter trays could be added to feed sheets along sheet path 120, if desired.

A corotron 44 through controller 55 charges a sheet to tack the sheet to belt 22 and to move the toner from belt 22 to the sheet. Subsequently, detack corotron 46 charges the sheet to an opposite polarity to detack the sheet from belt 22. Prefuser transport 48 moves the sheet to fuser E, which permanently affixes the toner to the sheet with heat and pressure. The sheet then advances to conventional stacker module F, or to duplex loop D.

Cleaner 50 removes toner that may remain on the image area of belt 22. In order to complete duplex copying, duplex loop D feeds sheets back for transfer of a toner powder image to the opposed sides of the sheets. Duplex inverter 90, in duplex loop D, inverts the sheet such that what was the top face of the sheet, on the previous pass through transfer, will be the bottom face on the sheet, on the next pass through transfer. Duplex inverter 90 inverts each sheet such that what was the leading edge of the sheet, on the previous pass through transfer, will be the trailing on the sheet, on the next pass through transfer.

Figure 3:
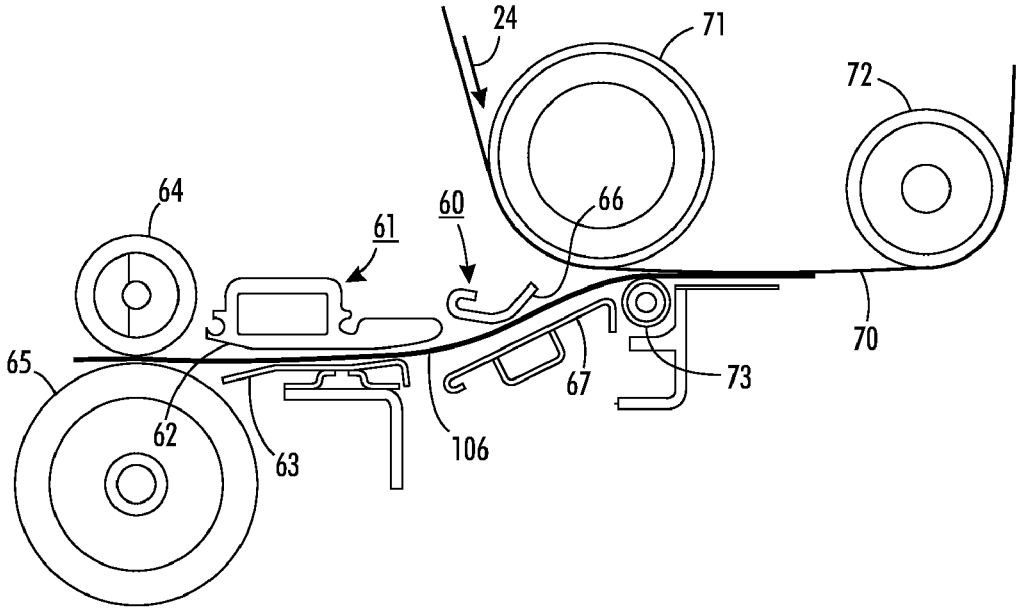
FIG. 3 is partial and enlarged frontal view of the dual position media registration transport and pre-transfer baffle subsystem shown in FIG. 2 with the transfer baffle in a first position.

With reference to FIG. 3 and in accordance with the present disclosure, an improved dual position media registration transport 61 and media pre-transfer baffle geometry 60 are shown that enable printing onto heavy weight media, e.g., for packaging. The dual mode registration transport 61 and media pre-transfer baffle assembly 60 are shown in a first position or configuration in FIG. 3, wherein normal media is conveyed by drive roll 65 and idler roll 64 and forwarded by registration transport 61 through an opening formed between baffles 62 and 63 and into pre-transfer baffle assembly 60 where baffles 66 and 67 form a chamber and an "S" shaped buckle is formed in the media 106 with an angle of engagement of media 106 with photoreceptor 70 of about 28°. This allows for some mismatch in velocities of a registration nip formed between drive roll 71 and idler roll 72 and the photoreceptor 70 which is entrained around drive roll 71 and idler roll 72. An idler roll 73 is used to maintain frictional contact between sheet 106 and photoreceptor 70.

Figure 4:
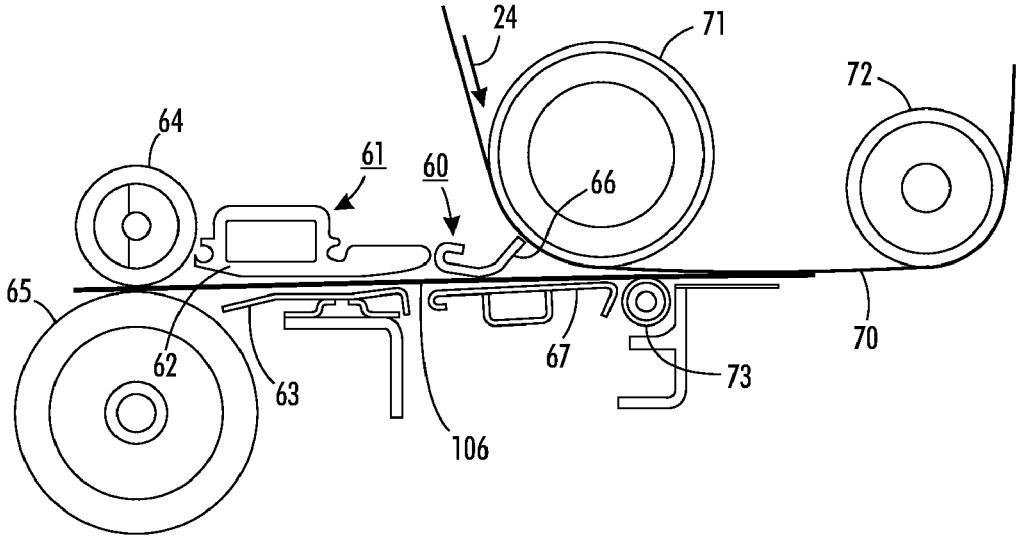
FIG. 4 is partial and enlarged frontal view of the dual position media registration transport and pre-transfer baffle subsystem shown in FIG. 2 with the transfer baffle in a second position.

Alternatively, as shown in FIG. 4, in order to feed sheets of heavy weight, i.e., of more than approximately 350 gsm, the dual mode registration transport 61 and media pre-transfer baffle assembly 60 have been moved manually by rotation of a knob (not shown) into a second operating position that straightens the paper path and enables heavy weight media and packaging materials to enter the pre-transfer area at an angle of approximately 2°.

Registration transport 61 and pre-transfer baffle 60 are articulated by conventional mechanical linkage connected to a knob. But while a manual articulation of the registration transport and pre-transfer baffle assembly is described, it is contemplated within the scope of the disclosure that movement of both the registration transport baffle and pre-transfer baffle could be automatically activated via mechanical linkages connected to a motor, if desired.

It should now be understood that an improvement has been disclosed that provides a dual-configuration media path (S-shaped and straight) which enable printing onto card stock, as well as, normal sheets with a single printer without major and costly modifications while simultaneously maintaining performance specifications. Several advantages are obtained with the use of the heretofore described dual mode pre-transfer geometry including: the ability to reconfigure the media transfer angle using two position hardware; allowing customer expandability into the packaging and labeling industry, allowing image transfer onto heavier weight medias; and broadening the sale of printers.

Claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A reprographic device, comprising:

a controller that receives an image signal representing an image to be printed;

a charge retentive surface;

a charging station that charges the charge retentive surface to a relatively high potential;

an exposure station that receives images signals from the controller and records an electrostatic latent image on the charge retentive surface;

a development station that deposits toner over the electrostatic latent image on the charge retentive surface to form a toner image;

a transfer station that transfers the toner image from the charge retentive surface to a recording media; and articulatable dual mode registration transport and dual mode pre-transfer baffle arrangements configured such that in a first mode normal weight recording media is accommodated and in a second mode heavy weight recording media is accommodated.

2. The reprographic device of claim 1, wherein said charge retentive surface is a photoreceptor.

3. The reprographic device of claim 2, wherein said photoreceptor is a belt.

4. The reprographic device of claim 3, wherein said articulatable dual mode registration transport and dual mode pre-transfer baffle arrangements are manually articulated.

5. The reprographic device of claim 1, wherein said dual mode pre-transfer baffle arrangement includes upper and lower baffles that are adapted to maintain a constraining, non-buckling profile on heavy weight media en route to a transfer hand-off point with said charge retentive surface when in said second mode.

6. The reprographic device of claim 5, wherein said baffles include portions that are parallel to each other.

7. The reprographic device of claim 1, wherein dual mode pre-transfer baffle arrangement when in said first mode includes upper and lower baffles that are adapted to allow an S-shaped profile within the normal recording media en route to a transfer hand-off point with said charge retentive surface.

8. The reprographic device of claim 1, wherein said dual mode registration transport arrangement is positioned in approximately the same horizontal plane as said dual mode pre-transfer arrangement when said dual mode pre-transfer baffle arrangement is in said second mode.

9. The reprographic device of claim 8, wherein said dual mode pre-transfer baffle arrangement facilitates changes in media contact angle with said charge retentive surface.

10. A method that includes a dual mode pre-transfer baffle arrangement in a printer enables printing onto both normal weight and heavy weight media, comprising:

providing a controller that receives an image signal representing an image to be printed;

providing a charge retentive surface;

providing a charging station that charges the charge retentive surface to a relatively high potential;

providing an exposure station that receives images signals from the controller and records an electrostatic latent image on the charge retentive surface;

providing a development station that deposits toner over the electrostatic latent image on the charge retentive surface to form a toner image;

providing a transfer station that transfers the toner image from the charge retentive surface to a recording media; and providing articulatable dual mode registration transport and dual mode pre-transfer baffle arrangement arrangements configured such that moving said dual mode registration transport and dual-mode pre-transfer baffle arrangement arrangements into a first mode promotes transport of normal weight media and moving said dual mode registration transport and dual-mode pre-transfer baffle arrangements into a second mode facilitate transport of heavy weight media.

11. The method of claim 10, including providing said charge retentive surface as a photoreceptor.

12. The method of claim 11, including providing said charge retentive surface as a photoreceptor is a belt.

13. The method of claim 12, including manually moving said dual mode pre-transfer baffle arrangement between said first and second modes.

14. The method of claim 10, including providing said dual mode pre-transfer baffle arrangement with upper and lower baffles that are adapted to maintain a constraining, non-buckling profile on heavy weight media en route to a transfer hand-off point with said charge retentive surface when in said second mode.

15. The method of claim 14, wherein said baffles include portions that are parallel to each other.

16. The method of claim 10, including adapting upper and lower baffles in said first mode to allow an S-shaped profile within the normal media en route to a transfer hand-off point with said charge retentive surface.

17. The method of claim 10, including positioning said dual mode registration transport arrangement in approximately the same horizontal plane as said dual mode pre-transfer arrangement when said dual mode pre-transfer baffle arrangement is in said second mode.

18. The method of claim 17, wherein said dual mode registration transport and dual-mode pre-transfer baffle arrangements facilitate changes in media contact angle with said charge retentive surface.

* * * * *